United States Patent [19]

Bala

[11] 3,948,425

[45] Apr. 6, 1976

[54] WEB HANDLING APPARATUS

[75] Inventor: John L. Bala, New Paltz, N.Y.

[73] Assignee: Packaging Industries, Inc., Hyannis, Mass.

[22] Filed: June 21, 1974

[21] Appl. No.: 481,918

Related U.S. Application Data

[63] Continuation-in-part of Ser. No. 382,319, July 25, 1973, abandoned.

[52] U.S. Cl. ..... 226/43; 226/49; 226/136

[51] Int. Cl.[2] ..... B65L 25/32

[58] Field of Search ..... 226/33.42, 43, 49, 169, 226/118, 143, 117, 136; 242/183–185

[56] References Cited

UNITED STATES PATENTS

| | | | |
|---|---|---|---|
| 2,631,530 | 3/1953 | Englund | 226/143 X |
| 3,124,290 | 3/1964 | Lloyd | 226/143 |
| 3,177,749 | 4/1965 | Best | 226/118 X |
| 3,240,411 | 3/1966 | Zarleng | 226/118 X |
| 3,310,249 | 3/1967 | Bryer | 226/118 X |

*Primary Examiner*—Richard A. Schacher
*Attorney, Agent, or Firm*—Brumbaugh, Graves, Donohue & Raymond

[57] ABSTRACT

A web handling mechanism is described for incrementally feeding a web of stretchable material (e.g., plastic film) to a processing station. The web feed rollers are driven by a motor incorporated in a servo system which electronically controls the feed rate, length of increment, dwell at processing station, etc. Variations in the speed and elasticity of a moving web are accommodated by means of a vacuum box adapted to accumulate a loop of the web material in the box and maintain proper tension on the web as supplied to the feed rollers. A detector in the vacuum box responds to a predetermined length of web accumulated in the box to trip a control circuit which actuates the feed roller motor to move the desired length of web through the processing station and then stop for a preselected interval. The circuit also controls the processing station to synchronize its operation with that of the web feed and the entire sequence is repetitive at high speed. Complete flexibility of operation is provided by the control circuit.

13 Claims, 6 Drawing Figures

10
20
21
22
23
24
25
26
27
28
29
30
32
33
33a
34
35
36
38
39
40
42
44
50
52
54
58
59
60
62
63
64
65
66
67
69
70
I
I

WEB HANDLING APPARATUS

BACKGROUND OF THE INVENTION

This application is a continuation-in-part of application Ser. No. 382,319, filed July 25, 1973 now abandoned.

The present invention relates to web handling apparatus and more particularly, to apparatus for incrementally moving a web of flexible, elastic material through a processing station while maintaining proper tension on the web.

There are many different applications wherein a web, e.g., a continuous sheet of paper, film, plastic, etc., must be made to pass through an apparatus while certain steps of manufacture or use are carried out with respect to the web.

While it is often possible to perform these steps of manufacture or use upon the web as the web is actually moving, e.g., printing in a printing press or recording on a tape recorder, there are situations wherein it is preferable or necessary to interrupt the movement of the web and hold it stationary at a given point during the time necessary to carry out the desired operation. Thus, for example, in the manufacture of plastic bags and the like, a double thickness or tube of thin plastic must be joined together along certain lines by the application of heat and perforated along other lines so as to form a continuous roll of bags, each of which is easily torn from the end of the roll along the perforated line. The heat joining operation is most conveniently accomplished by compressing the double thickness of plastic between heated sealing heads which seal the plastic at the points of contact between the heads and the plastic. Similarly, the perforations are made by a tool which is merely forced against the web at the same time as the sealing heads are operated. These operations are more practically carried out while the web is momentarily stationary since it would be impractical to arrange the sealing head and cutting tool so as to move in conjunction with the web during the time of contact with the web and then back up to repeat the operation upon succeeding portions of the web. This, then, requires that the moving web be momentarily stopped at the sealing and perforating station. In other words, the web must be fed incrementally to the processing station, and, for economically practical operation, this must be accomplished at high speed and with precision.

Since the web ordinarily would be obtained from a continuous supply, such as a roll, the feeding from the source must be coordinated with the intermittent stopping and starting of the web at the processing stations — e.g., the sealing and perforating stations. In a conventional installation, a pair of nip rollers positively engage the web adjacent the processing station and are driven by some means to feed a desired length of web, and stopped for the time necessary to complete the processing step, the sequence being repeated for the length of the run. To control the web supply in comparable incremental fashion would present a number of difficulties, amongst which would be the virtual impossibility of accurately starting and stopping the unwinding, at high repetition rate, of a heavy roll of web material so as to feed the short web segments between operations of the processing station. This difficulty is accentuated when the web is both stretchable and fragile.

Aside from the supply problem, the feeding of a thin, elastic web to a processing station in incremental fashion presents a complex synchronization and control problem. Presently known systems for such incremental web feeding suffer from several drawbacks which impose severe restrictions on their operation, particularly with respect to uniformity of increment length and speed. Conventionally, the drive or nip rollers are powered by an electric motor through a mechanical clutch coupling which, by its very nature, is incapable of the rapid, accurate starting and stopping necessary to produce precisely sized products at high speeds. Backlash, slippage and other mechanical limitations necessitate a complicated indexing structure, not only making it difficult to control the feed increment with precision, but rendering adjustments in the feed increment and dwell time at the processing station intricate and time consuming to accomplish.

Prior art web handling systems present a further drawback, especially when thin, stretchable webs, such as used for plastic bags, are involved, namely, maintenance of proper tension on the web as it is moved through the apparatus. Insufficient tension of a thin film (e.g., 1 to 10 mils) can cause wrinkling in the finished product and inaccuracies in the processing step. On the other hand, too much tension can stretch and even tear the film, with obviously undesirable results. One form of known tensioning system employs a series of resiliently mounted idler rollers around which the web is threaded before reaching the drive rollers. While under ideal conditions, such a system may function adequately, the rollers are prone to sticking and require constant attention. Moreover, they are difficult to adjust for varying tensions and the initial threading is time consuming. These arrangements also require relatively careful synchronization of the web supply with the drive means.

SUMMARY OF THE INVENTION

The present invention provides a novel web handling system in which the drawbacks of prior art systems are avoided. Incorporated in the applicant's novel system is an all electronic web indexing arrangement controlling a servo motor for the drive rolls which enables extremely accurate incremental feeding of the web to the processing station. By means of the novel electronic circuit, simple, precise and reproducible control of all the parameters of the feed, e.g., incremental length, dwell time, speed, etc., may be effected, with no mechanical adjustment of the apparatus. The operator need only change the appropriate dials on the control panel for the electronic circuitry. The inherently rapid response of the servo motor to control signals from the circuitry permits faster through-put of web and at the same time, enables precise accuracy of incremental length and dwell time.

Coupled with the electronic indexing and drive system is an improved web tensioning system which not only simplifies the initial threading operation, but ensures that proper tension is maintained on the web at all times. Briefly, the web tensioning mechanism comprises a vacuum box in which a loop of web is maintained between the supply roll and the nip or drive rollers. The vacuum box has an open top into which a length of web is drawn, thus forming a loop within the box. A level detector within the box detects the extent to which the web has been drawn into the box and is interconnected with the indexing system to initiate operation of the latter. Thus, the nip rollers will not feed an incremental length of web to the processing station unless and until the vacuum box sensing mechanism has informed the nip roller drive control that an adequate length of web is available in the box. The possibility of overtensioning of the web is thereby avoided. The sensing mechanism also controls a drive motor for the web supply to slow down when a full loop is present in the vacuum box, thereby preventing insufficient tension and avoiding wrinkling, misalignment, etc.

The foregoing and other objects, features and advantages of the invention will become more apparent from the following detailed description of a preferred embodiment thereof, taken in conjunction with the accompanying drawings, in which.

GENERAL

Figure 1:
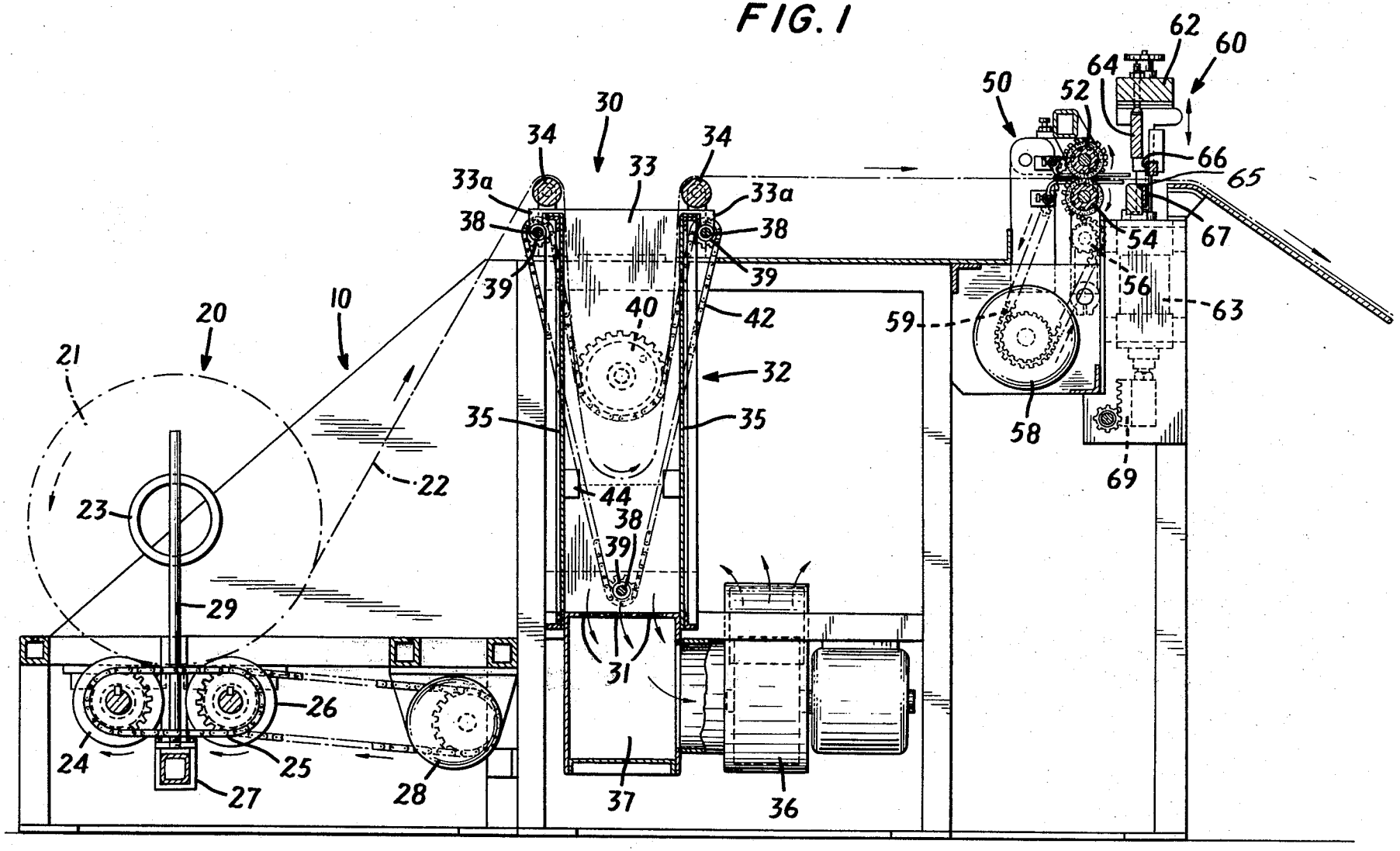
FIG. 1 is an overall schematic elevation view of the web handling system of the invention, taken along the line 1—1 of FIG. 2.
Figure 2:
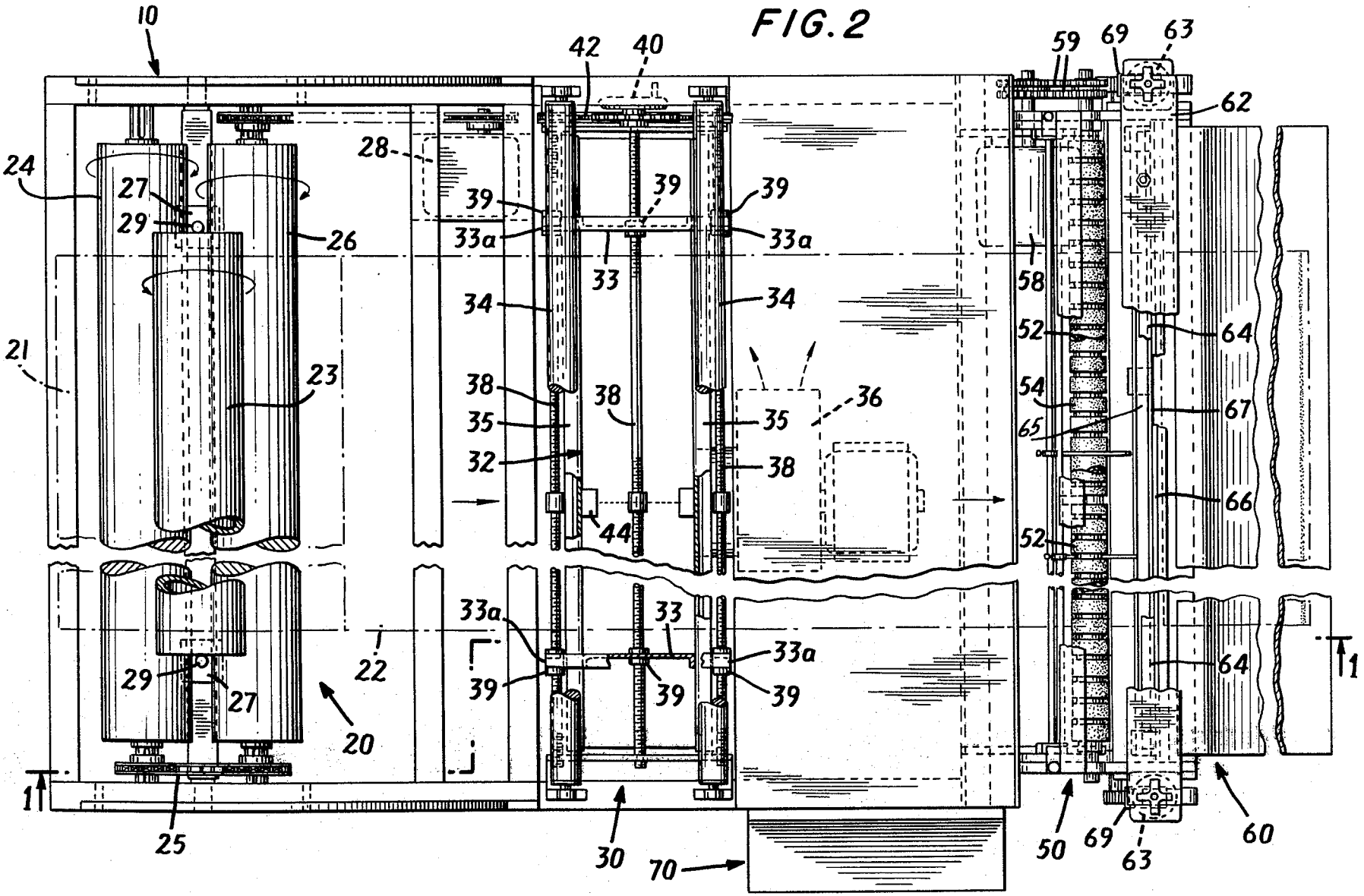
FIG. 2 is a plan view of the web handling apparatus of the invention.

The overall web handling system of the present invention is illustrated in FIGS. 1 and 2. In these drawings, the numeral 10 refers to the frame structure for supporting the various operational components of the system. For purposes of simplification, and to avoid obscuring the important details of the novel structure, the frame 10 is indicated only schematically; it being understood that the fabrication of a suitable frame to support the various machine components is a matter of engineering skill and does not form a part of the present invention.

The preferred embodiment of the web handling system of the invention is made up of five basic units: web supply means 20, tensioning means 30, drive means 50, processing station 60 and control system 70. The web supply source may be a roll 21 of web material arranged to be unwound and fed to the remainder of the apparatus, as illustrated, or an in-line source, such as an extrusion system which processes raw materials to produce the film and feeds it directly to the tensioning means 30.

From the supply source, i.e., roll or in-line supply, the web passes to a tensioning device indicated generally by the reference numeral 30. The details of this device will be discussed below, but for present purposes it is sufficient to note that it performs the dual functions of maintaining the web fed to the processing station at the proper tension and of initiating the operating cycle of the system.

The numeral 50 in FIGS. 1 and 2 denotes the drive or nip roller system which moves the web through the apparatus. As will be described hereinafter in detail, the drive rollers are operated by a motor controlled by an electronic servo system which enables highly accurate and repetitive starting, stopping and speed control of the rollers, and consequently, the movement of the web.

A processing station for operating on the web 22 is designated by the numeral 60. By way of example, the invention will be described as it is applied to the production of plastic bags, commonly used for trash and the like. To form such bags, a web 22, in the form of a flattened, continuous tube of plastic film of a thickness between 1 and 10 mils, is heat sealed at precise intervals along its length and then either scored for later tearing or severed adjacent the seal, so that the seal forms a closed end of a finished bag. The illustrated processing station 60 then, includes the combination of a heat sealing bar and a knife blade in close proximity, which are rendered operative in appropriately timed relationship to the movement of the web.

The supply means 20, the tensioning 30, the drive means 50 and the processing means 60 are all under control of a master electronic system contained in a housing designated by the numeral 70 in FIG. 2. The housing contains all of the necessary circuitry, in printed and integrated circuit form, to synchronize operation of all of the components of the system to perform in the manner desired by the operator. The circuitry of the control system 70 and its interaction with each of the units 20, 30, 50 and 60 will be described in detail hereinafter.

Web Supply

FIGS. 1 and 2 illustrate a web supply in the form of a roll 21 of web material. The roll is supported on its peripheral surface by a pair of rollers 24, 26, suitably journaled at their ends in the frame 10. The roller 24 is coupled by a chain 25 to the roller 26 which is driven by an electric motor 28, so that the roll is unwound in the direction indicated by the arrows in FIG. 1. If desired, the supply roll 21 may be restrained from movement in its axial direction by means of a pair of upright members 29, one at either end of the roll, which are adjustable on a channel 27 in the frame extending transversely of the roll. The roll is provided with a tubular core 23, which extends beyond the edges of the film on both sides thereof for engagement of the uprights 29. It will be seen then, that as the motor 28 operates, the roll is rotated in the direction shown to unwind the film 22 for feeding to the remainder of the apparatus. The roller system shown enables a new roll of film to be inserted merely by placing it on top of the rollers and adjusting the edge restraints 29. No spindle for the roll, and its required supporting members, are necessary.

The speed of the motor 28 is adjustable to control the rate of web supply and its operation is synchronized with the timing cycle of the overall system. This will be described in further detail in connection with the explanation of the control system.

Tension Control

The tension control means 30 comprises a rectangular box 32 having its upper side open to the atmosphere and its bottom coupled through openings 31 to a plenum 37 for the blower or vacuum source 36. The vacuum box 32 extends transversely of the direction of movement of the web and is longer than the widest web to be accommodated by the overall system.

Journaled in suitable brackets affixed at the ends of the uppermost edges of the sidewalls 35 of the box 32 are a pair of idler rollers 34 over which the web 22 passes. The box is closed at its bottom by the plenum 37 and the lower pressure side of the blower 36 is coupled to the plenum through one of its sidewalls. Between the rollers 34, the web is drawn downwardly into the box by the action of the blower 36, which creates a lower than atmospheric pressure condition at the bottom of the box. The blower 36 is of any appropriate type, e.g., a centrifugal fan, of sufficient capacity to provide the required vacuum force.

It will be understood that the term "vacuum" is used herein to denote a pressure differential condition wherein the pressure of the ambient fluid, e.g., air, is lower on one side of the material subjected to the vacuum force than on the other.

A level detecting means 44 is arranged within the box to detect the presence of a loop of web at the level at which the detector is set. The detector means is positioned in the box so that the length of a loop (between rollers 34) whose lower extremity reaches the detector is of a preselected value. Typically, this length would be slightly greater than the longest increment of feed expected between process steps, although as will be explained, the web length between process steps may be increased in multiples of the preselected length by cycling the apparatus with processing station held inoperative for one or more increments.

The detector 44 may be of any suitable type, such as an air jet diaphragm switch which closes when a jet of air is interrupted by the loop, a similarly responsive photoelectric switch or a mechanical limit switch. The particular type of switch employed would depend on such factors as the thickness of the film, its stiffness and its opacity. It has been found that an air jet diaphragm detector, such as made by Industrial Hydraulic Corp. under the designation Pneumaid Jet Sensor Model 2500, with Model 1000E Booster Assembly, is suitable for most, if not all, applications.

The system of the invention is capable of accommodating webs of different widths, different weights or thicknesses, and of applying different amounts of tension to the web. Also, more than one web at a time can be processed, provided they can fit side by side across the width of the apparatus without overlap. With each variation in web parameter, the vacuum force applied in the vacuum box 32 must be adjusted to maintain appropriate tension on the web. The vacuum box 32 incorporates a simple, easily manipulated mechanism for accomplishing all of the necessary changes. As seen most clearly in FIG. 2, the vacuum box 32 is provided with a pair of vertical end walls 33, fitting between the sidewalls 35. At each of the uppermost corners of each end wall is provided lug or ear 33*a*, which carries a follower nut 39. Towards the bottom of each end wall 33 a similar follower nut 39 is mounted, approximately midway between the vertical edges. The follower nuts 39 threadedly engage corresponding rotatable split lead screws 38, the ends of which are suitably journaled in the frame. All three lead screws are interconnected, by an endless belt 42, with a hand wheel 40, each of the lead screws 38 and the hand wheel 40 having an appropriate pulley engaged by the belt 42. The lead screws 38 are split, that is to say, each half of the lead screw has a thread oppositely wound with respect to each other. As the hand crank 40 is turned, the resultant rotation of the lead screws 38 causes the movable walls 33 to move in concert towards or away from each other, symmetrically with respect to the center of the box, thereby changing its effective length and volume.

The tension applied to the web and the length of the loop within the vacuum box is determined by the magnitude of the vacuum force applied to the web and this in turn is controlled by the position of the movable end walls 33 with respect to the edges of the web. Thus, with a constant vacuum force being applied by the blower 36, the closer the end walls are to the edges of the web, i.e., the less leakage there is around the web, the greater the force tending to draw the web towards the bottom of the vacuum box. Conversely, the greater the gap between the edge of the web and the sidewalls of the vacuum box, the greater the leakage and the less vacuum force applied to the web. In operation of the system, the vacuum force is adjusted by manual actuation of the hand wheel 40 at the beginning of a run to accommodate the specific requirement presented by the material and process conditions.

Drive System

The drive system 50 comprises a pair of drive or nip rollers 52, 54, whose outer surfaces may be covered with a frictional material such as rubber for positively gripping the thin web material that passes between them. For better gripping characteristics and to minimize distortion of the web, the rolls 52, 54 are segmented into a plurality of closely spaced, coaxial roller surfaces, as shown in the drawing, so that the film is gripped at a plurality of closely spaced portions transverse of its length, rather than continuously across its length.

The drive rollers are driven by a reversible DC electric motor 58 through one or more belts 59. The belts 59 are of the type commonly used for timing functions, having teeth for positive engagement with gear type pulleys on the motor and the roller shafts. An idler pulley 56 maintains the belts 59 in close contact with the pulleys on the ends of the rollers 52 and 54, to minimize the possibility of slippage. The rollers 52 and 54 are journaled in the frame 10 in an appropriate manner.

The motor 58 is operated by a servo system, making it susceptible of accurate electronic control, whereby the rotation of the rollers 52 and 54, and thus the film 22, may be very precisely regulated. The details of the motor and its servo drive system will be described below in conjunction with the control circuitry of the system.

Process Station

In the embodiment shown, the process station comprises a combination sealing and cutting (or scoring) station to complete a plastic bag. Other process steps, such as printing, notching, folding, embossing, etc., may be employed in place of or in addition to the one shown herein with equal facility, depending on the use to which the overall system is put.

As illustrated, the process station 60 comprises a support member 62 extending transversely across the film path, on the underside of which is supported a heated sealing bar 64 and a severing blade 66. The sealing bar 64 cooperates with a stationary anvil 65 such that when the support bar 62 is lowered, the sealing bar 64 bears against the anvil, and the resultant heat and pressure applied to the web seals the two sides of the flattened tube together across the width of the web. The knife blade 66, by the same downward movement of the bar 62, acts with stationary blade 67 to sever the web at a point immediately downstream of the seal. The severed section of the web is a bag closed on three sides.

Preferably, the support bar 62 (with its sealing bar 64 and blade 66) is normally maintained at an elevated position relative to the anvil 65 by a pair of pneumatic cylinders 63 at either end of the bar. The piston rod of each of the cylinders is coupled by a rack and pinion link 69 to the respective ends of the support bar whereby movement of the piston causes corresponding movement of the support bar 62. Fluid pressure in the cylinders is controlled by solenoid actuated valves which, when energized, operate the pneumatic cylinders to lower the bar into operative contact with the anvil at the appropriate pressure to form the seal and make the cut. Preferably, both the sealing bar 64 and anvil 65 are electrically heated to a suitable temperature and the dwell time, i.e., the period during which the bar and anvil are closed on the web, is adjustable.

Control Circuitry

Figure 3:
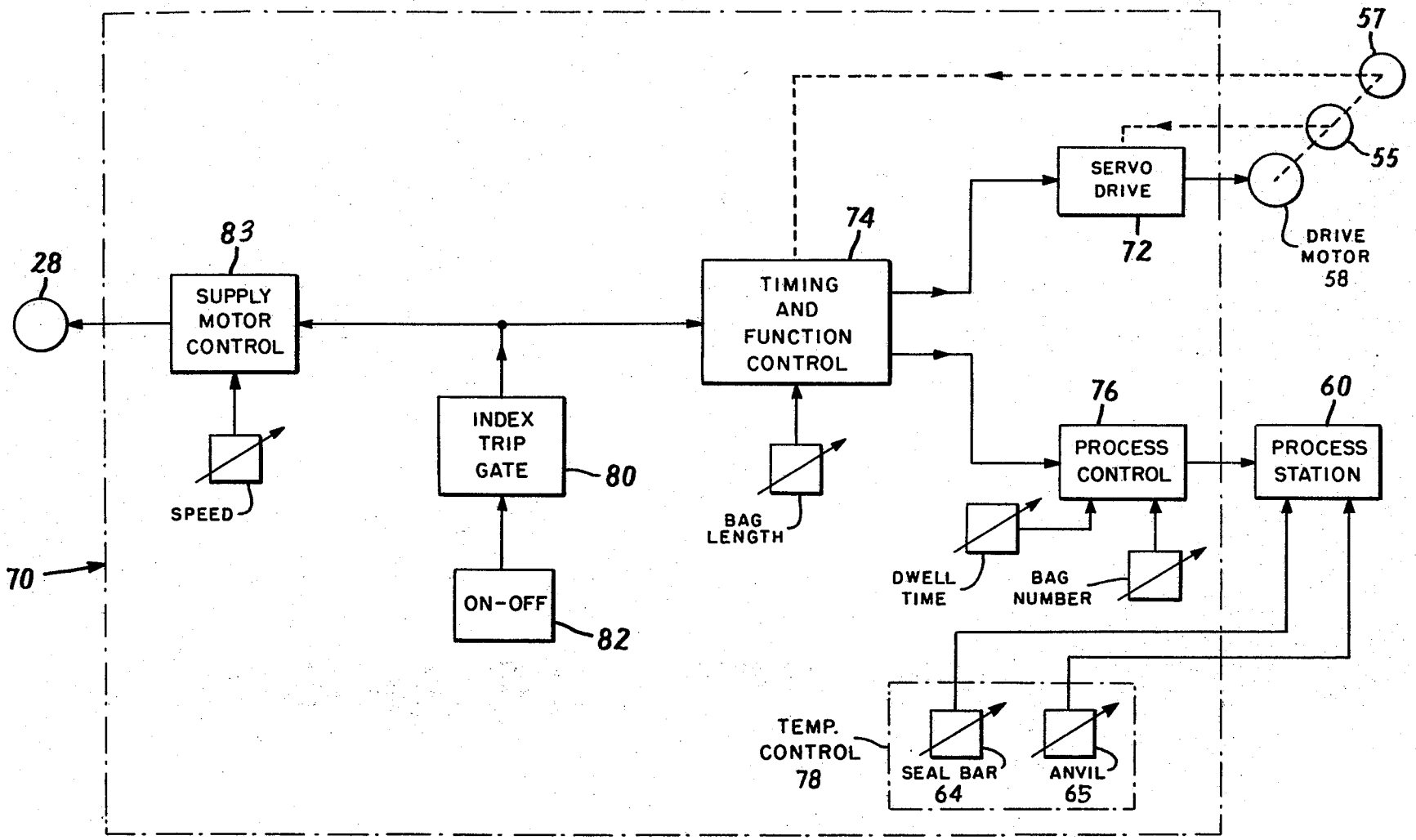
FIG. 3 is an overall block diagram of the electronic control system for the web handling system of the present invention.

The control circuitry contained in the housing 70 of FIG. 2 is shown in functional block form in FIG. 3. The circuit performs the function of automatically controlling the amount of web moved between process steps, (e.g., bag length), the length of time within each such operating cycle alotted for performance of the process step (e.g., dwell time of the heat sealing means), the total number of cycles to be performed by the system before shutting off (e.g., the number of bags to be made during the run), and the repetition rate of the cycle (e.g., number of bags per minute).

Bag length is dependent on the amount of rotation of the drive motor 58 which turns the nip rollers 52, 54 (FIG. 1) to feed the web through the processing station. The drive motor 58 is a bidirectional DC motor of the type commonly employed in servo systems and, as is conventional in such systems, has a tachometer 55 and an encoder 57 driven by its output shaft. The tachometer gives speed information to the servo drive control apparatus 72 and the encoder, a pulse generator actuated by rotation of the motor, provides an indication of the amount of rotation of the motor. For example, if the encoder generates 1000 pulses per revolution of the shaft, an encoder pulse count of 1500 pulses would indicate that the motor has rotated 1½ revolutions. This in turn, can readily be correlated with the length of web moved by the nip rollers.

The servo drive control apparatus for the drive motor is a standard type of unit employing silicon controlled rectifiers to supply DC signals to regulate the speed and direction of the motor. Such drives and motors controlled by them are well known in the art and are in common usage in many applications. In the commercial model of the system of the present invention, the motor employed, was Model A-150 made by Hyper-Loop, Inc. and the servo drive was the Model 45HL, S601R, also made by Hyper-Loop, Inc. As will be explained more fully hereinafter, the timing and function control circuitry 74, upon actuation, supplies an analog signal to the servo control which causes a precisely timed period of operation of the drive motor and then brings the motor to a stop.

The timing and function control circuitry 74 also initiates operation of the process control circuitry 76 at a point in the cycle properly synchronized with the operation of the drive motor 58. Thus, as the drive motor comes to a halt after feeding a prescribed length of web through the process station, the process control circuitry is actuated to energize the solenoid valve controlling the supply of fluid to the pneumatic actuators for the sealing and cutting mechanism. By the time the sealing bar and cutting blade reach the anvil, the web has come to a complete stop. The amount of time the solenoid valve stays closed, which encompasses the travel time down and back up of the sealing and cutting members as well as the period during which the sealing bar 64 is in sealing engagement with the web, is variable and is preset by the operator in accordance with the characteristics of the material to be sealed. As also indicated in FIG. 3, the sealing bars 64 and the anvil 65 are separately temperature controlled by means 78 manually adjustable by the operator. Those controls regulate the currents supplied to electrical resistance heating elements incorporated in the members 64 and 65.

At the conclusion of the process step, the timing and function control circuitry is recycled to be responsive to a trip input, provided the preset number of cycles, (i.e., number of bags to be made) has not yet been reached.

Tripping of the timing and function control circuit is performed by a gate circuit 80 to which the detector 44 in the vacuum box 32 is coupled. When a loop of web of sufficient length to reach the detector 44 has been accumulated in the vacuum box, there is available to the drive rollers sufficient web for the length of bag to be produced, under proper tension. The actuation of the detector 44 enables the trip gate 80 to energize the timing and function control circuit to start the servo drive. A manual ON-OFF switch 82 overrides the index trip 80 to render the entire system subject to operator control.

The speed of the drive motor and the duration of the processing step within each cycle, can be regulated by appropriate settings of the timing and function control circuitry and the process control. There will be however, a minimum cycle time for each bag length dictated by the response time of the servo drive system and the requirements of the process step.

The gate 80 cannot be activated until an index trip signal is received from the vacuum box. Consequently, the number of cycles per unit time, or cycle repetition rate of the apparatus is dependent upon the speed at which the loop of film in the vacuum box is reconstituted to the level of the detector after a length has been removed by the drive rolls. This in turn is dependent upon the speed of the motor 28 driving the supply roll 26. As indicated in FIG. 3, a speed control 83 for the motor 28 is provided which can be manually adjusted to establish a desired repetition rate. The speed control is also responsive to the index trip signal to lower the speed of the motor 28 when the web reaches the detector level to prevent overfilling of the vacuum box 32.

Figure 4A:
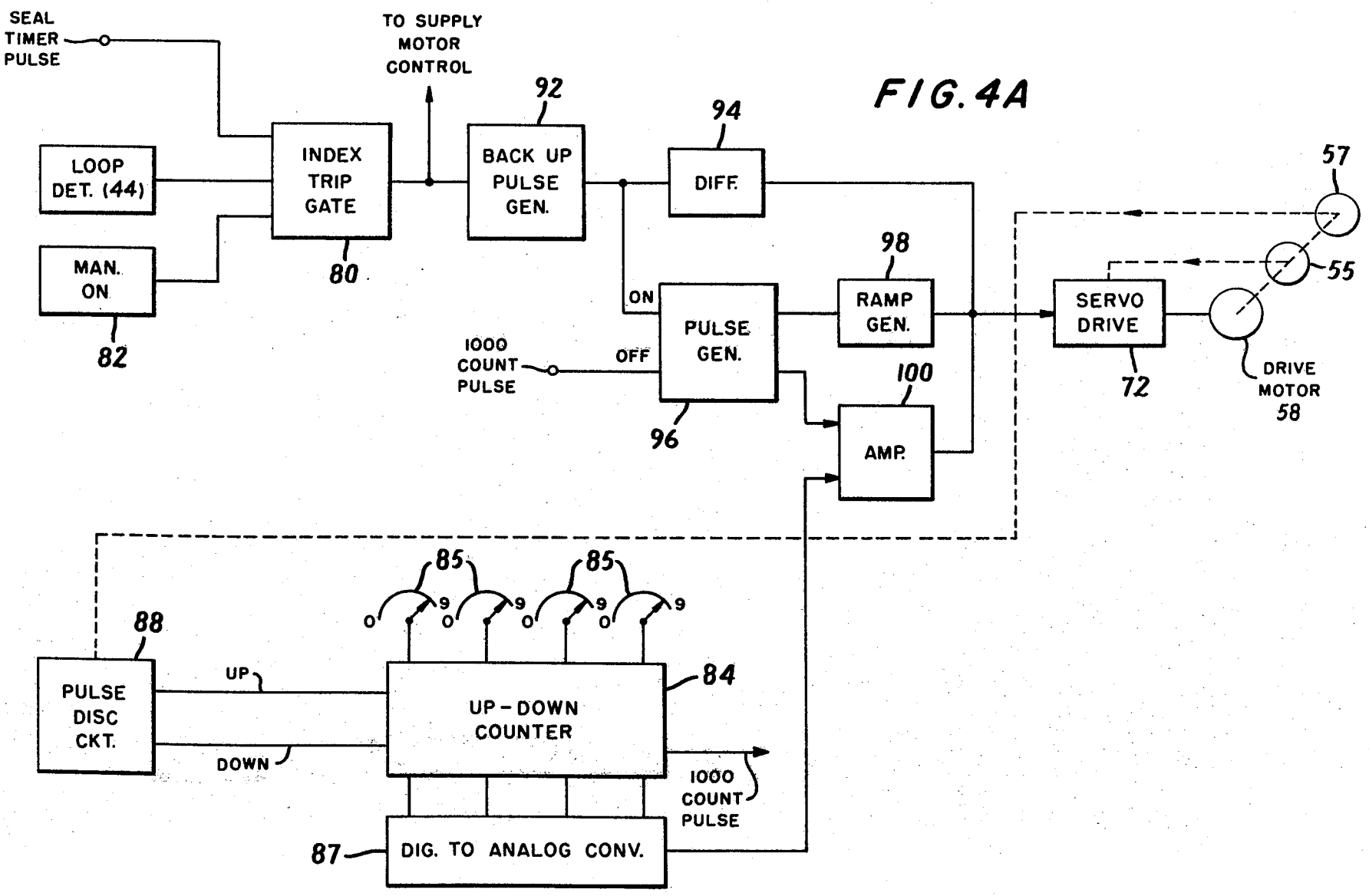
FIG. 4A is a block diagram of the drive signal generating portion of the control system.

The timing and function control circuitry 74 is shown in greater detail in FIG. 4A. The heart of the circuit is a four stage binary-coded-decimal counter 84, each stage of which can be manually preset to a value representing the digits 0 to 9 by means of thumb wheels or rotary switches 85.

As indicated in FIG. 4A, the counter 84 is of the "up-down" type, that is it can count either up or down from a reference position. Such counters are well known in the data processing field and the type known as the Signetics Synchronous Decade Up/Down Counter With Preset Inputs, No. N74192, four units of which are cascaded, has served satisfactorily for the counting function of the present circuit; a greater or lesser number of stages may be employed to suit the system parameters, e.g., increment length. The counter 84 is symmetrical about zero, i.e., it counts −0001, 0000, +0001, etc., (the digital indication including a sign bit) and provides outputs to a digital-to-analog converter 87, the purpose of which will be described hereinafter.

As explained above, the encoder 57, driven by the drive motor 58, provides a train of uniform pulses indicative of the amount of rotation of the motor. Such devices also provide an indication of the direction of rotation of the drive motor by introducing a 90° phase displacement between the pulse train representing rotation in the clockwise direction and the pulse train representing the counterclockwise direction of rotation.

The pulses from the encoder 57 are fed to a pulse discriminator circuit 88 which detects the phase of the pulse train to determine the direction of rotation of the drive motor 58. The circuit 88 routes the encoder pulses to one of two outputs, corresponding to the respective directions of rotation, which are coupled to the up-down steering inputs for the counter 84. For reasons which will become apparent below, the direction of rotation of the motor 58 corresponding to forward movement of the web through the processing station provides the down pulse train while the opposite direction of rotation provides the up pulse train.

An output connection from the counter 84 is also provided which will indicate (by a binary 1 level) when the pulse count reaches the 1000 mark.

The interaction of the control circuitry of FIG. 4A and the units of the web handling system of FIGS. 1 and 2 will now be described in conjunction with the waveforms of FIG. 5.

Prior to initiating a run, the operator will set into the counter 84, by manual actuation of the switches 85, a predetermined count corresponding to the desired bag length. He will also set the temperature controls 78 for the sealing elements (FIG. 3) to the desired temperature for the material being employed. The dwell time control for the process control 76 will also be set at the appropriate period and the desired number of cycles, i.e., bags, to be run will be set into the bag counter (see FIG. 4B). The nominal running speed for the motor 28 will also be set by adjustment of the supply motor control 83 (FIG. 3). All of the necessary manual controls are located on a panel mounted on the housing 70.

The web supply is threaded into the system simply by taking the free end of the web and bringing it over the rollers 34 to the nip rollers 52, 54. The servo motor 58 is provided with a manual control (not shown) by means of which it can be rotated independently of its control system to move a short length of the web through the rollers and permit the latter to firmly grasp it. If the web supply is in the form of a roll 21, such as shown in FIG. 1, the roll is simply lowered in place on the rollers 24, 26 and the sidebars 29 adjusted to align it properly with respect to the path through the system. The blower motor 36 may then be turned on to provide the vacuum in the vacuum box 32 and the sidewalls 33 adjusted to regulate the tension on the web. The supply roll may be unwound by hand, or by brief operation of motor 28, to provide enough slack in the web to develop the loop in the vacuum box 32.

If the web is drawn from a continuous, on-line supply, the same procedure is followed except of course that the supply system including motor 28 and rolls 24, 26, is not employed. The web is threaded in the same fashion described above.

Before beginning the run, electrical power is turned on to all components of the system so that they may be operated when triggered. If desired, the web may be fed through the processing station and the latter actuated by an associated manual control (not shown) to seal and trim the edge of the web. The system is now ready for the run.

Figure 5:
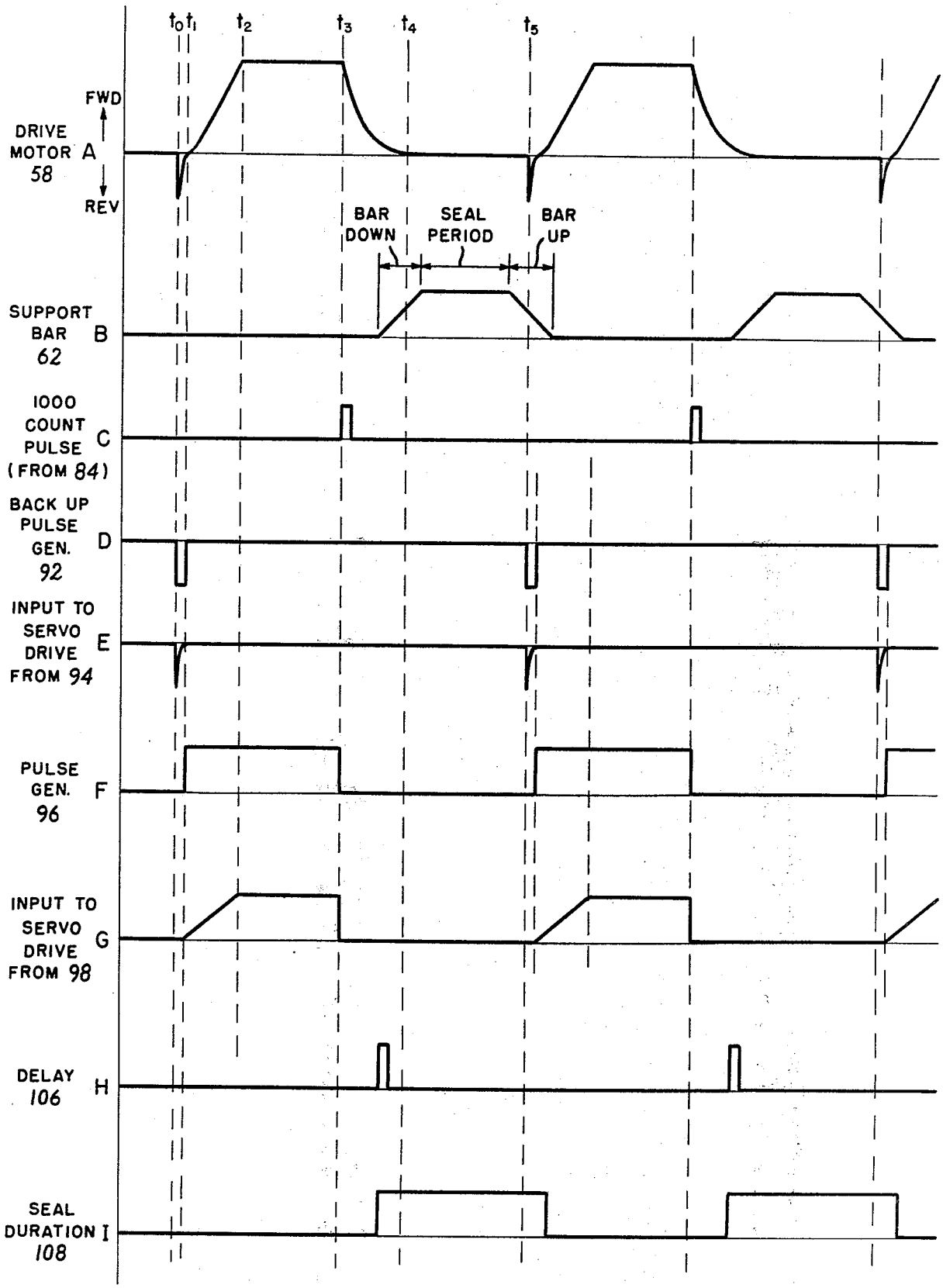
FIG. 5 is a series of waveforms helpful in understanding the operation of the control system.

The velocity profile of the drive motor 58 is shown in curve A in FIG. 5. The beginning of the operating cycle is indicated at the time $t_0$At the beginning of the cycle, the motor 58 is operated for a short time period, $t_0$ to $t_1$, in a reverse direction. This is to ensure separation of the sealed edge of the bag from the sealing anvil to which it may adhere after the sealing process is completed. In known types of sealing mechanisms, this separation is effected by means such as air blasts or mechanical lifters which are complex in structure and difficult to synchronize with the overall operation of the system. In the present system, the virtually instantaneous response of the servo motor and drive system makes it possible to produce the very brief reverse action of the drive rolls to perform the release action. The extent of this reverse or back-up movement is determined by the duration of a readily controllable electrical pulse supplied to the servo drive means and as will be discussed below, this pulse is accurately measured by the counter 84 and automatically accounted for in computation of the bag length.

At the conclusion $t_1$ of the back-up period, the drive motor 58 is linearly accelerated, in the opposite or forward direction, to a velocity maximum at $t_2$ chosen to be compatible with the material of the web and the overall machine function. The motor 58 continues at this constant velocity for the period $t_2 - t_3$. At $t_3$, motor 58 begins its deceleration which, as shown in curve A, follows a hyperbolic decline asymptotically approaching zero velocity at time $t_4$. The web is then held stationary for a period, $t_4$ to $t_5$, during which time the process step is carried out on the web. It will be seen then, that the length of web fed through the process station is determined by the operation of the drive motor 58 in the time $t_1$ to $t_4$.

In FIG. 4A, the circuitry for generating the velocity profile of curve A of FIG. 5 and its relationship to bag length is illustrated. The index trip gate 80 is seen to have three inputs, all of which must be present to actuate the gate. These are the manual ON (82), the indication from the loop detector 44, and a timer pulse from the process station (signifying that the process being performed on the web has been completed, i.e., the web has been released). Assuming that all of the inputs are present, the index trip gate provides an output which triggers the back-up pulse generator 92. The latter produces an output pulse of short duration as indicated in curve D of FIG. 5. The back-up pulse is differentiated in differentiator circuit 94 to provide a short duration pulse, as indicated in curve E, of a polarity which, when applied to the servo drive unit 72, will cause the drive motor 58 to rotate in a direction to back up the web from the process station. The back-up pulse applied to the servo drive then causes the drive motor 58 to rotate in a reverse direction for the duration of the pulse.

The reverse rotation of the motor 58 causes the encoder 57 to generate a plurality of pulses indicating the extent of the reverse rotation. The encoder pulses are applied to the pulse discriminator circuit 88 which detects that the pulses indicate a reverse rotation of the motor 58 and applies them to the "up" input of the counter 84. The number of pulses generated during the back-up pulse is then added to the number preset in the counter 84. Thus, if the counter 84 was preset, for example, to the number 4000, signifying that the length of the bag to be produced is equal to the amount of web advanced by four revolutions of the drive rollers, and if the back-up pulse rotated the motor 58 1/1000 of a revolution, ten pulses would be added to the count preset in the counter 84, giving a total of 4010 actually stored in the counter. As will be appreciated, since the actual extent of the back-up of the web is added to the preset bag length, the full bag length is fed through the process station during the cycle.

The trailing edge of the pulse from the generator 92 serves to trigger a pulse generator 96 of the flip flop type to its ON or binary 1 state. The 1 output of the generator 96, indicated as curve F in FIG. 5, is supplied to a ramp generator circuit 98, which is an integrating circuit with a clamped output, producing a waveform of the shape shown in curve G. The output of the ramp generator 98 will stay at its constant maximum value until turned off by a change in state of the pulse generator 96.

The ramp output of generator 98, a DC voltage, is supplied to the servo drive 72 and is of a polarity to produce motor rotation in the forward direction, i.e., from the supply towards the processing station.

The shape of the ramp output causes the motor 58 rapidly and linearly to accelerate to its maximum speed (at time $t_2$), at which speed it remains until time $t_3$. During the entire period of rotation of the motor 58, the encoder 57 is generating pulses at the coded rate, e.g., 1000 pulses per revolution, and supplying them to the pulse discriminator circuit 88. Since these pulses reflect rotation of the motor 58 in a direction moving the web forwardly through the system, the pulse discriminator circuit couples them to the down input of the counter 84. The latter then counts down from its preset value (plus the back-up indication) as long as the drive motor 58 rotates.

The total cycle time of the system is compressed by anticipating the end of the increment of web feed. For this purpose, an output signifying a pulse count of some predetermined value prior to the end of the desired increment is obtained from the counter; in the example shown, a signal indicative of the pulse count 1000 is employed.

The 1000 count pulse is supplied to the pulse generator 96 to return it to its initial state, i.e., binary 0. Termination of the pulse output from the generator 96 also terminates the output of the ramp generator 98. At the same time, however, the change of state of the pulse generator 96 unblocks an amplifier 100 to whose input is continually supplied the output of the digital-to-analog converter 87 which produces an output signal corresponding to the changing counter content. Thus, at the same time that the output of ramp generator 98 ceases, an output indicative of the pulse count is provided through now unblocked amplifier 100 to the servo drive 72. Since the counter 84 is decreasing in count, the output of the digital-to-analog converter 87 and thus the signal applied to the servo drive 72 is decreasing. This in turn decelerates the motor 58 at a corresponding rate. Meanwhile, the encoder output 57 is decreasing in repetition rate (since the rotation of motor 58 is slowing) and the rate at which the countdown progresses correspondingly decreases. This changes the digital-to-analog converter output and results in further slowing of the motor 58. The result of this feedback is to decelerate the drive motor 58 in a hyperbolic mode asymptotically approaching zero velocity. At time $t_4$, the motor 58 stops, holding the web stationary until such time, $t_5$, as all of the three inputs to the gate 80 simultaneously re-occur. (Actually, the motor 58 locks between several counts above and below zero, but the resultant web movement is negligible.) During the period $t_4$ to $t_5$, the process step is carried out on the stationary web.

Figure 4B:
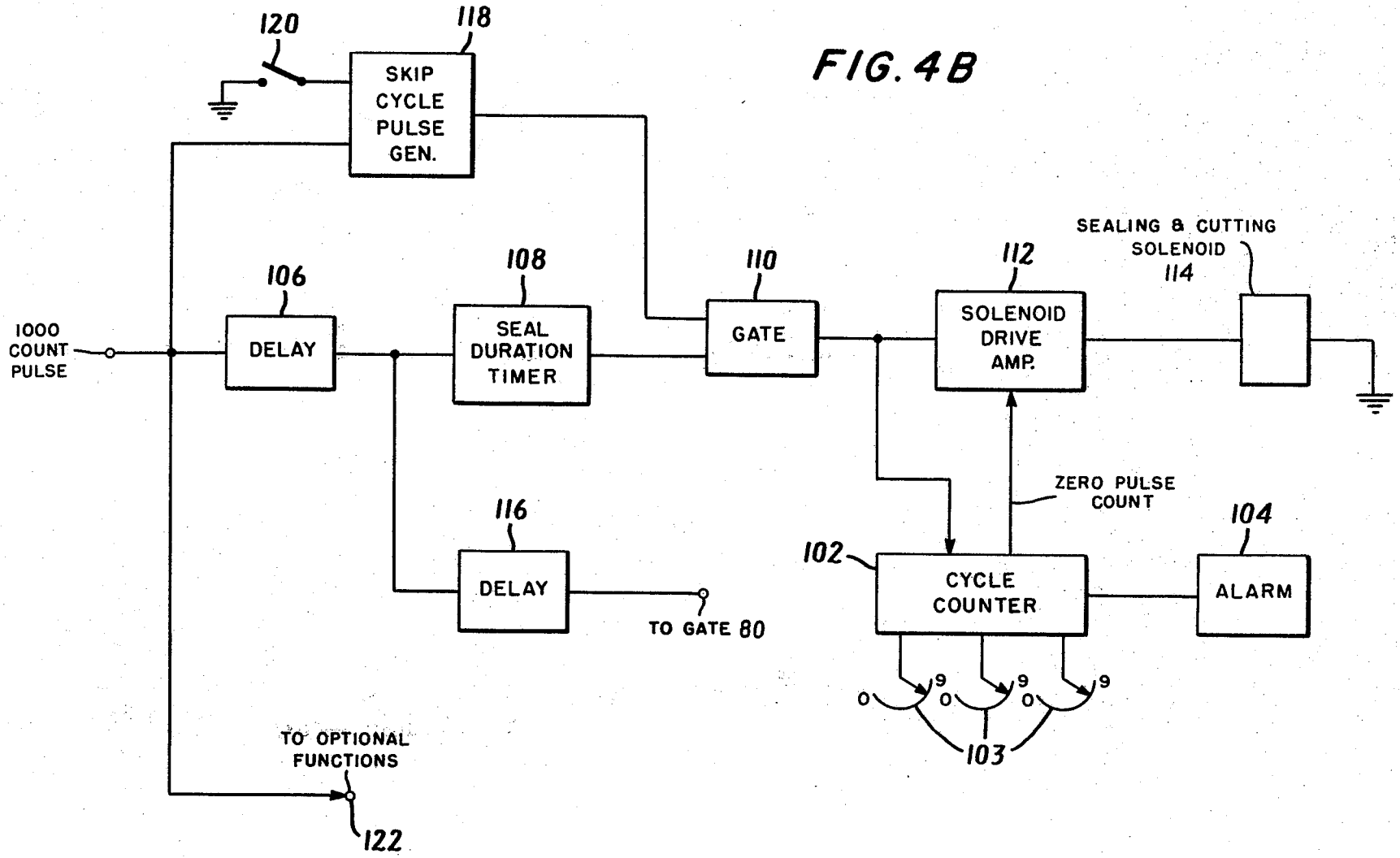
FIG. 4B is a block diagram of the process control circuitry of the invention.

The circuit for operation of the process step is shown in block form in FIG. 4B. The ultimate result of energization of the circuit of 4B is to operate the solenoid valve 114, which in the present example of the bag making machinery, is the valve which controls the air supply to the pneumatic piston-cylinder arrangements which control the position of the support bar 62 carrying the heat sealing element 64 and the knife 66. When the solenoid valve 114 is energized, air is supplied to the cylinders to lower the bar 62 into operative contact with the web. When the solenoid valve is deenergized, the sealing and cutting elements are moved up and out of engagement with the web.

The counter 102 is generally similar in construction to the counter 84 in FIG. 4A and can be preset by controls 103 to any desired number. In the drawing, a three stage counter is shown but it will be realized that any number of stages can be cascaded to provide higher count totals. With the counter 102 preset to the number of cycles, i.e., number of bags, desired during the run, each time the solenoid valve 114 is activated to complete a process step, the counter is tripped to count down one digit. As the counter number approaches zero, an alarm 104 is actuated by a pulse output, for example pulse 50, to advise the operator that the end of a run is approaching. The zero pulse prevents further operation of the process station, such as by disabling the drive amplifier 112.

Timing of operation of the circuitry of FIG. 4B is synchronized with the servo drive apparatus by the 1000 count pulse from the counter 84. This operation will be better understood by reference to the waveforms of FIG. 5. The 1000 count pulse (curve C) is delayed by circuit 106 by an amount such that it occurs sometime between $t_3$ and $t_4$ (curve H). The delayed pulse triggers the seal duration timer 108 which produces an output pulse of adjustable duration (curve I). This pulse is fed through the normally open gate 110 to energize the solenoid drive amplifier 112 which in turn energizes the sealing and cutting solenoid 114.

As will be understood, a finite time is required for the sealing and cutting elements to move from their rest position to their operative position and vice versa. This time is a function of the pneumatic system and drive elements and can be accurately measured. Accordingly, the period of operation of the process step will include the two fixed increments corresponding to movement of the process members plus the variable increment corresponding to the length of time the seal bar actually is bearing against the web material. Consequently, variation in the pulse length of the seal duration timer 108 has the effect of varying the length of time heat is actually being applied to perfect the seal. This can be varied by the operator to accommodate the thickness and type of material being employed.

The anticipating 1000 count pulse permits reduction of the overall cycle time by enabling the period of operation of the process station to be overlapped with that of the drive system. Referring to curves A and B of FIG. 5, it will be seen that the movement of the seal bar 62 towards its sealing position is started before the drive motor 58 has brought the web to a complete stop. Of course, the sealing bar does not reach the anvil until a short time after the web is brought to a complete stop. In similar fashion, the movement of the sealing elements back up to the rest position may be accomplished while the drive cycle for the next increment of web has begun. It is necessary only that the seal bars release the web prior to the beginning of movement of the web. In the circuit of FIGS. 4A and 4B, this is assured by making the index trip gate 80 inoperative until it is actuated by a pulse representative of the conclusion of the process step. Such a pulse is derived through delay 116 which produces a pulse output at a time in the seal operation as the seal bar separates from the web begins it upward movement. It is thereby assured that the next machine cycle cannot begin until the web has been released, i.e., the process step has been completed.

As indicated hereinabove, the maximum incremental length of feed of the web between process steps is determined by the maximum length of loop capable of being accumulated in the vacuum box 32. As a practical matter, it has been found that the longest bag, i.e., increment of web feed, of importance is approximately 60 inches. By control of the counter 84, any increment from as little as 2 inches up the 60 inch maximum may be attainable. On occasion, however, it is desired to produce a bag greater than the 60 inch length and the apparatus of the invention is capable of operation to produce such an increment of feed with minimum of modification. In FIG. 4B, the structure necessary to enable such a mode of operation is shown by the skip cycle generator 118 and the manual switch 120.

The basis for this elongated increment feed is the elimination of the process step between successive incremental feeds. Thus, if the apparatus is set for a 40 inch feed increment and the sealing and cutting step is eliminated during every other operating cycle, the distance between successive sealings and cuttings will be 80 inches, thereby producing bags of that length.

This skip cycling is achievable by providing an appropriately timed pulse from the generator 118 to block the gate 110 during every other cycle of the machine. The skip cycle generator 118 is synchronized by the 1000 count pulse from the counter 84 and may consist simply of a flip flop which changes state in response to each 1000 count pulse. In one state, the gate 110 is closed, to prevent the output of the seal duration timer from energizing the solenoid drive amplifier 112; in the other state, the gate is open and the solenoid actuated. The skip cycle pulse generator 118 is turned on by a manually actuated switch 120 as desired. The skip cycle option thus enables double the maximum increment of web to be fed between process steps, although two machine cycles, and therefore twice the cycle time, are required for such an increment of web to be fed. By suitable modification of the pulse generator 118, two or more consecutive process steps may be blocked to provide triple or greater multiples of the basic maximum web length.

Also shown in FIG. 4B is an additional output terminal 122 at which the 1000 count pulse is preset. This indicates schematically that other process steps, e.g., stacking, printing, embossing, etc., in addition to the sealing and cutting, may be carried out within the given machine cycle. By appropriately extending the period of delay provided by the circuit 116, the time period, $t_4$ to $t_5$, may be suitably extended to enable an additional process step or steps to be carried out. The 1000 count pulse provides a convenient reference point from which to synchronize the operations of these other process steps.

From the foregoing, it will be appreciated that the web handling system of the present invention combines a novel array of web handling components with a unique all electronic control system which enables precise and readily adjustable control of the web in all points in its movement through the apparatus. The inherent characteristics of the servo drive system allow high speed operation with precise and repeatable accuracy in the incremental feeding of thin, elastic webs. Heretofore, complex and bulky mechanical drive systems used for this purpose have not only been expensive, but have suffered from inaccuracy and difficulty in adjustment. The all-electronic control of the present invention provides a degree of flexibility such that changes in speed, bag length, timing of the process steps, etc., can be instantly varied by simple manipulation of electrical switches and dials in seconds and can be effected even during a run. This flexibility minimizes the manpower required to supervise operation of the apparatus and greatly reduces down time of the system.

It is to be understood that many modifications of apparatus disclosed herein will become apparent to those skilled in the art and it is intended that the invention be limited only as set forth in the appended claims.

I claim:

1. In a web handling system in which increments of a continuous web are cyclically fed by a pair of rolls from a web supply through a process station at which an operation is performed on the web, said system further including means between said supply and said pair of rolls for accumulating a loop of web under predetermined tension, means for controlling operation of said rolls comprising, an electric motor directly coupled to said rolls whereby rotation of said motor always causes corresponding rotation of said rolls, pulse generating means coupled to said motor for producing a train of pulses representative of the extent and direction of rotation of said motor, bi-directional pulse counter means capable of being manually preset to a predetermined count corresponding to a desired length of the increment of web to be fed through said process station in each cycle of operation, means coupling the output of said pulse generating means to said counter to cause said counter to count up or down depending upon the direction of rotation of said motor, operation of said motor to move said web from said supply through said process station causing said counter to count down towards a zero count from said predetermined count, sensing means operable in response to the accumulation of a loop of web of predetermined length at least as great as said increment, voltage generating means responsive to operation of said sensing means to initiate rotation of said motor, said voltage generating means including first circuit means for generating a voltage pulse of a polarity to cause said motor to rotate in the direction to withdraw the web from said process station towards said supply, second circuit means actuated upon termination of said voltage pulse for generating a unidirectional voltage of a polarity to cause said motor to rotate in the direction to move the web from said supply to said process station, means coupling said voltage pulse and said unidirectional voltage successively in the order named to said motor to cause corresponding rotation thereof, and means operative when the number of pulses produced by said pulse generating means in response to rotation of said motor in the direction to move the web from said supply to said process station equals a total count preset in said counter, to stop rotation of said motor.

2. The web handling system of claim 1 wherein the total count preset in said counter comprises a predetermined count manually preset in said counter plus an additional count corresponding to pulses generated by said pulse generating means upon rotation of said electric motor in a direction to withdraw the web from said process station towards said supply in response to the voltage pulse generated by said first circuit means.

3. The apparatus of claim 1 further comprising digital-to-analog converter for converting pulses indicative of the current count in said counter to an analog voltage, means providing a separate output pulse from said counter indicative of said counter reaching a fixed count above zero and smaller than said preset predetermined count, and third circuit means responsive to said counter output pulse to terminate said unidirectional voltage and couple the analog voltage from said digital-to-analog converter to said motor, whereby said motor decelerates to a stop at the zero count at a rate determined by the rate of decrease of the count in said counter.

4. The apparatus of claim 3 wherein the unidirectional voltage generated by said second circuit means includes a first portion of linearly increasing amplitude for causing linear acceleration of said motor, followed by a constant amplitude portion for causing said motor to rotate at constant speed.

5. The apparatus of claim 3 wherein said process station is rendered operative in response to said fixed count output pulse from said counter.

6. In a web handling system in which increments of a continuous web are cyclically fed by a pair of rolls from a web supply through a process station at which an operation is performed on the web, means for controlling operation of said rolls comprising, an electric motor directly coupled to said rolls whereby rotation of said motor always causes corresponding rotation of said rolls, pulse generating means coupled to said motor for producing a train of pulses representative of the rotation of said motor, pulse counter means capable of being manually preset to a predetermined count corresponding to a desired length of the increment of web to be fed through said process station in each cycle of operation, means coupling the output of said pulse generating means to said counter to cause said counter to change its count relative to a preset count upon rotation of said motor, first circuit means for initiating rotation of said motor during each cycle and causing it to operate said rolls to move said web through said process station, and second circuit means responsive to said counter reaching a preselected pulse count smaller than said predetermined count simultaneously to render said first circuit means ineffective to cause rotation of said motor and to cause further rotation of said motor in response to the magnitude of the pulse count in said counter, whereby rotation of said motor slows as the number of pulses produced by said pulse generating means approaches the predetermined count preset in said counter and stops when the number of pulses produced by said pulse generating means equals the predetermined count preset in said counter.

7. The web handling system of claim 6 further comprising, means responsive to said counter reaching said preselected pulse count for activating said process station to operate on said web when said desired length increment of web has been fed through said process station in each cycle of operation.

8. The web handling system of claim 6 further comprising, means between said web supply and said rolls for maintaining the web supplied to said rolls under predetermined tension.

9. The web handling system of claim 6 wherein said first circuit means includes means operative at the beginning of each cycle to rotate said motor for a brief interval in a direction opposite to that for moving said web from said supply through said process station, whereby said web is first withdrawn from said process station and then fed through said process station by said rolls.

10. In a web handling system in which increments of a continuous web are cyclically fed by a pair of rolls from a web supply through a process station at which an operation is performed on the web, web drive means comprising, an electric motor directly coupled to said rolls whereby rotation of said motor always causes corresponding rotation of said rolls, signal generating means coupled to said motor for producing an electrical signal representative of the rotation of said motor, circuit means coupled to said motor for causing rotation thereof in accordance with voltages applied thereto, first voltage generating means for producing and applying to said circuit means a voltage for initiating operation of said motor and causing it to feed said web from said supply to said processing station at speeds dependent upon the magnitude of said voltage, the magnitudes and duration of the voltage produced by said first voltage generating means being controllable independently of the operation of said motor, and second voltage generating means responsive to the electrical signal produced by said signal generating means for producing and applying to said circuit means a voltage for reducing the speed of operation of said motor and terminating feeding of said web.

11. The apparatus of claim 10 wherein the voltage outputs of said first and second voltage generating means are applied seriatum to said circuit means.

12. The apparatus of claim 10 wherein said first voltage generating means is controlled to produce a voltage output having a first portion linearly increasing in magnitude to a predetermined level, and a second portion having a magnitude constant at said level.

13. The apparatus of claim 10 wherein said second voltage generating means responds to the electrical signal from said signal generating means to produce a voltage output decreasing hyperbolically to zero.

* * * * *